US011335136B2

(12) United States Patent
Ibing

(10) Patent No.: US 11,335,136 B2
(45) Date of Patent: May 17, 2022

(54) METHOD FOR ASCERTAINING ILLEGAL DRIVING BEHAVIOR BY A VEHICLE

(71) Applicant: Robert Bosch GmbH, Stuttgart (DE)

(72) Inventor: Andreas Ibing, Beilstein (DE)

(73) Assignee: Robert Bosch GmbH, Stuttgart (DE)

( * ) Notice: Subject to any disclaimer, the term of this patent is extended or adjusted under 35 U.S.C. 154(b) by 244 days.

(21) Appl. No.: 16/456,019

(22) Filed: Jun. 28, 2019

(65) Prior Publication Data

US 2020/0005562 A1 Jan. 2, 2020

(30) Foreign Application Priority Data

Jul. 2, 2018 (DE) ..... 102018210852.8

(51) Int. Cl.
*G07C 5/08* (2006.01)

(52) U.S. Cl.
CPC ..... *G07C 5/0808* (2013.01); *G07C 5/085* (2013.01)

(58) Field of Classification Search
CPC ..... G07C 5/0808; G07C 5/085; G07C 5/08; G08G 1/0112; G08G 1/0133; G08G 1/0141; G08G 1/052; G08G 1/017; G08G 1/205; G08G 1/207; G08G 1/0175; G08G 1/054; G08G 1/04
See application file for complete search history.

(56) References Cited

U.S. PATENT DOCUMENTS

| | | | | |
|---|---|---|---|---|
| 2007/0103339 | A1* | 5/2007 | Maxwell | G08G 1/164 340/942 |
| 2011/0066317 | A1* | 3/2011 | Lee | G07C 5/085 701/31.4 |
| 2011/0234749 | A1 | 9/2011 | Alon | |
| 2020/0166897 | A1* | 5/2020 | Campos | B60R 11/04 |

FOREIGN PATENT DOCUMENTS

| | | | |
|---|---|---|---|
| DE | 19824855 | A1 | 12/1999 |
| DE | 102008041166 | A1 | 2/2010 |
| DE | 102011015945 | A1 | 10/2012 |
| DE | 102017115309 | A1 | 1/2018 |

* cited by examiner

*Primary Examiner* — Michael V Kerrigan
(74) *Attorney, Agent, or Firm* — Norton Rose Fulbright US LLP; Gerard Messina

(57) ABSTRACT

A method for ascertaining illegal driving behavior of at least one road user in the surroundings of a vehicle includes the surroundings being detected by vehicle sensors, a surroundings model being created based on the sensor data of the vehicle sensors, an illegal behavior of the at least one road user being detected on the basis of the surroundings model, and the sensor data in a time window of the detected illegal behavior being stored as evidence.

8 Claims, 2 Drawing Sheets

METHOD FOR ASCERTAINING ILLEGAL DRIVING BEHAVIOR BY A VEHICLE

CROSS-REFERENCE TO RELATED APPLICATIONS

The present application claims priority under 35 U.S.C. § 119 to DE 10 2018 210 852.8, filed in the Federal Republic of Germany on Jul. 2, 2018, the content of which is hereby incorporated by reference herein in its entirety.

FIELD OF THE INVENTION

The present invention relates to a method for ascertaining illegal behavior of at least one road user in the surroundings of a vehicle. Moreover, the present invention relates to a control unit, a computer program, and a machine-readable memory medium.

BACKGROUND

Motorists are frequently endangered and bothered by road users in traffic due to illegal behavior which can constitute a misdemeanor or a criminal offense. Such illegal behavior can be, for example, excessive speed, illegal passing, or tailgating. Although such violations often do not result in accidents, they can cause fear and uncertainty in the affected motorists. Such violations are often not reported due to lack of evidence and due to the bureaucratic burden.

Methods for monitoring a speed of road users are already known. In particular, such methods are utilized by authorities for monitoring speed. Such methods can be subdivided into stationary systems and mobile systems.

The so-called "police pilot system" is often utilized in mobile systems, for example, in civil emergency vehicles. For this purpose, the emergency vehicle must travel behind a road user at a distance which remains constant or increases. This takes place within a defined period of time and is monitored in a camera-based manner. After the period of time has elapsed, the speed of the followed road user can be calculated.

DE 10 2017 115 309 A1 describes an autonomous police vehicle which carries out, in an automated manner, routine policing tasks, such as issuing tickets for speeding or disregarding a stop sign. Further related art is known from DE 10 2011 015 945 A1 and US 2011/0234749 A1.

The approaches previously known involve a high level of administrative effort and are to be actively carried out by the particular operators. In particular, there is no possibility for the affected drivers to secure the evidence of such a situation and forward it to the authorities.

SUMMARY

An object underlying the present invention can be considered to be that of providing a method for ascertaining and demonstrating traffic violations.

According to one aspect of the present invention, a method is provided for ascertaining illegal behavior of at least one road user in the surroundings of a vehicle. In one step, the surroundings of the vehicle are detected by vehicle sensors. Based on the sensor data of the vehicle sensors, a surroundings model is created, in particular, by a control unit of the vehicle. In one further step, an illegal behavior of at least one road user is detected on the basis of the surroundings model. After a detection of the illegal behavior, the sensor data in a time window of the detected illegal behavior are stored as evidence.

According to a further aspect of the present invention, a control unit is provided, which is configured for carrying out all steps of the method according to the present invention.

According to a further aspect of the present invention, a computer program is provided, which encompasses commands which prompt a computer or a control unit to carry out the method according to the present invention when the computer program is run by the computer or the control unit.

According to a further aspect of the present invention, a machine-readable memory medium is provided on which the computer program according to the present invention is stored.

Automated vehicles, in particular, semi-automated, highly automated, or fully automated vehicles, include a plurality of vehicle sensors. Such vehicle sensors can be camera sensors, radar sensors, LIDAR sensors, ultrasonic sensors, and the like. As a component of their automated driving function, these vehicles continuously calculate a surroundings model, a so-called perception. This surroundings model calculation contains the tracking of other vehicles or the following of the trajectories of adjacent road users.

The surroundings model calculated by the automated vehicles can be utilized for detecting illegal behavior of other road users. In particular, the road users can be continuously checked for illegal behavior in the surroundings of the automated vehicle.

In the event of a detection of a rule violation, the gathered sensor data for the relevant time window can be cryptographically signed and stored. The sensor data can encompass, for example, video recordings or images, using which an identification of the road users via a license plate is enabled. Moreover, the driver can also be identified on the basis of the sensor data. Optionally, facial recognition can be utilized for identifying the driver.

The following traffic violations can be detected, for example, using an automated vehicle:

tailgating and, therefore, duress;
excessive speed;
illegal passing;
applying the brakes to slow other road users;
obstructing a passing attempt;
passing on the right; and
disregarding the rule of staying on the right.

If such a traffic violation is detected, the sensor data necessary as evidence thereof are stored in a memory unit. The memory unit can be situated vehicle-internally or vehicle-externally. An automated way to secure evidence can therefore be implemented, which can reduce a bureaucratic burden.

Due to the method according to the present invention, a comprehensive and reasonably priced way to monitor traffic can be carried out, which can replace or at least reduce previous cost-intensive monitoring approaches carried out by authorities. Due to an increasing number of monitoring approaches, the gathering of evidence for such violations can be optimized and a deterrent effect can be achieved. The number of traffic violations and accidents can therefore be lowered and traffic safety can be enhanced.

According to an example embodiment of the method, the sensor data are stored as evidence in an encrypted and/or cryptographically signed manner. Preferably, the vehicle software and hardware, at least in the area of at least one responsible control unit, can be designed to be tamperresistant and manipulation-proof. As a result, the integrity of the sensor data saved as evidence can be ensured and protected.

According to an example embodiment of the method, the sensor data in the time window of the detected illegal behavior are stored vehicle-internally in a memory of a control unit or vehicle-externally in a memory of a server unit. As a result, the relevant sensor data can be quickly and efficiently stored vehicle-internally. Alternatively, the gathered sensor data, which are utilized as evidence for an illegal behavior of a road user, can be transmitted to a vehicle-external server unit via a communication link and stored or further processed in the server unit. For example, the sensor data can be analyzed and evaluated vehicle-externally.

According to an example embodiment of the method, the sensor data stored as evidence can be transmitted to a monitoring authority via a communication link to an external server unit for the purpose of preparing or creating a report. Due to the method according to the present invention, the possibility can be implemented for a driver, which simplifies the reporting process. This can be implemented, in particular, using the automatic evidence gathering, by the vehicle, in the case of illegal behavior of other road users and using an automatic reporting of the illegal behavior to authorities.

The detection of an illegal incident can be communicated to the driver via a so-called human-machine interface. The driver can initiate a message to the authorities with the press of a button. For this purpose, the sensor data relevant for the incident are transmitted via the communication link, which can be a mobile radio link, to a back-end software or the external server unit which can create a report, in accordance with the regulatory standards, on the basis of the transmitted data.

According to an example embodiment of the method, in order to detect an illegal behavior by at least one road user, distances between the road users and between the vehicle and the road users are ascertained and are evaluated based on the speed of the particular road users. The vehicle can utilize the vehicle-internal sensors for this purpose. The vehicle sensors can be, for example, cameras, radar sensors, LIDAR sensors, ultrasonic sensors, GPS sensors, wheel sensors, and the like. Sensor data or measuring data are continuously generated using the vehicle sensors. The sensor data can be present, for example, in the form of point clouds and Doppler shifts, video recordings, traffic sign recognitions, and position data.

Perception algorithms can create a surroundings model based on the sensor data, which includes a separation of static surroundings and moving objects. Other vehicles, in particular, are recognized as moving objects and their movements are followed using tracking algorithms. In this case, in particular, a calculation of positions, speeds, and directions of other road users takes place. The surroundings model is created in the scanning area of the sensors of the vehicle and, due to predictions, can extend beyond the scanning limits of the vehicle sensors. Local information, such as speed limits or no-passing zones, is available as map data and/or is delivered by the traffic sign recognition of the vehicle.

A speed-dependent safety distance between the road users can be defined on the basis of the calculated speeds. Measuring errors of the vehicle sensors and errors of the surroundings model can be taken into account using tolerance ranges. Based on a threshold value comparison, a check can be carried out to determine whether a sufficient safety distance is being observed.

According to an example embodiment of the method, the speeds of the road users in the surroundings of the vehicle are compared to a permissible maximum speed in order to detect illegal behavior by at least one road user. As a result, the ascertained speeds of the road users can be compared to local speed limits. The speed limits can be utilized as a threshold value in this case. The speed limits can be ascertained by reading signs and/or using navigation maps.

According to an example embodiment of the method, in order to detect illegal behavior by at least one road user, the trajectories of the road users in the surroundings of the vehicle are detected and are checked with respect to local no-passing zones or illegal passing processes. Due to the method according to the present invention, lanes and lane changes by the road users are detected and are checked with respect to violation of a local ban on passing. The appropriate trajectories can be taken from the surroundings model and saved as evidence.

Preferred example embodiments of the present invention are explained in greater detail in the following with reference to highly simplified schematic representations.

DETAILED DESCRIPTION

Figure 1:
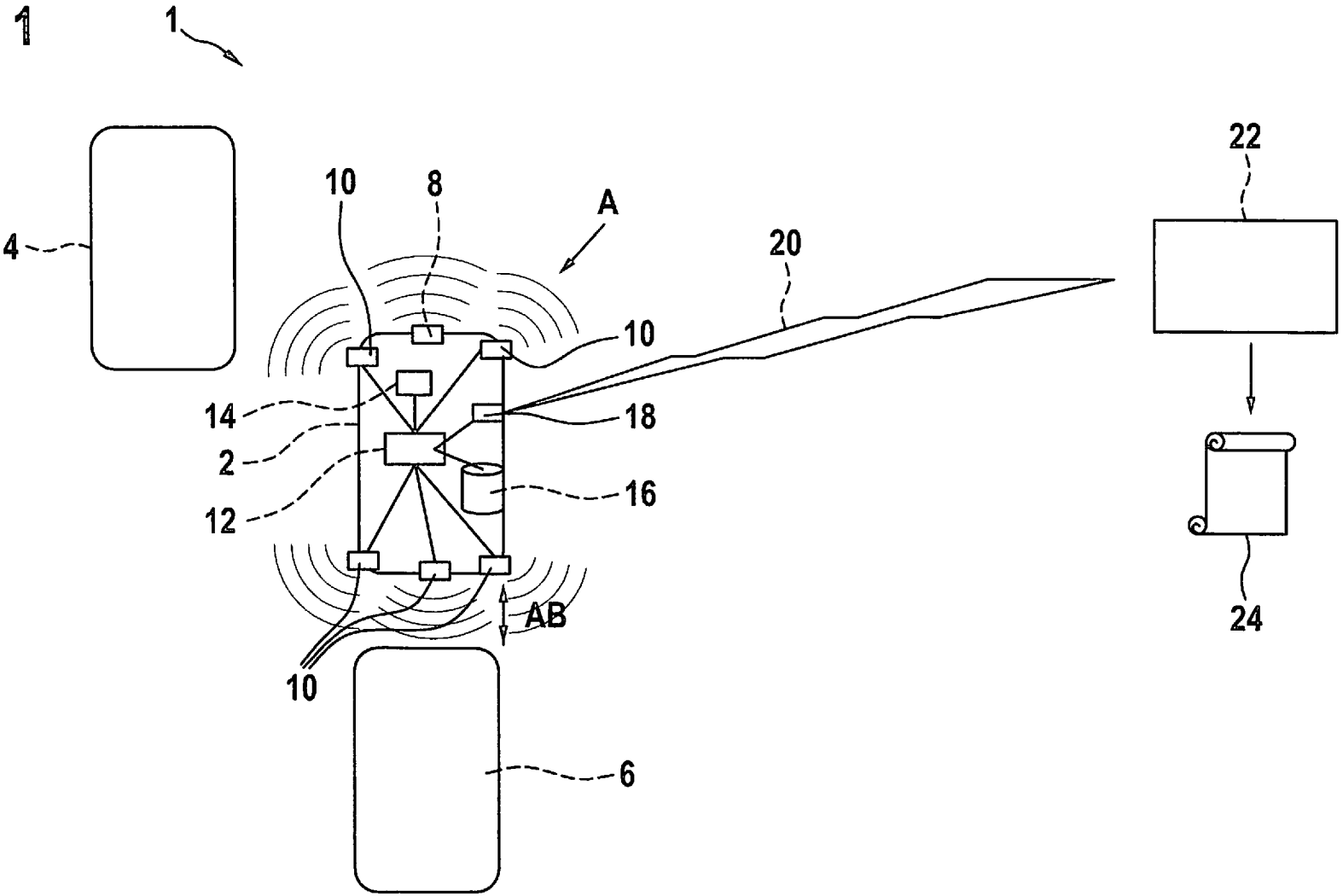
FIG. 1 shows a schematic representation of a vehicle arrangement for carrying out a method according to an example embodiment of the present invention.

FIG. 1 shows a schematic representation of a vehicle arrangement 1. For the sake of simplicity, one automatable vehicle 2 and two further road users 4, 6 are represented. Further road users 4, 6 are likewise vehicles which are situated in a scanning area A of vehicle 2.

Vehicle 2 includes a vehicle-internal sensor control unit 8 which is coupled to vehicle sensors 10 in a data-transmitting manner. Sensor control unit 8 is utilized for reading out vehicle sensors 10. The read-out sensor data of sensor control unit 8 are transmitted to a vehicle-internal control unit 12. Alternatively or additionally, vehicle sensors 10 or a portion of vehicle sensors 10 can be data-conductively coupled directly to control unit 12. Control unit 12 is configured for evaluating the sensor data gathered using vehicle sensors 10 and creating a surroundings model based on the sensor data. Moreover, control unit 12, together with vehicle sensors 10, is configured for carrying out the method according to the present invention. For example, control unit 12 can be a driver assistance control unit encompassing a surroundings model and a violation detection unit.

Vehicle sensors 10, according to an example embodiment, are radar sensors, although they can also be LIDAR sensors, ultrasonic sensors, camera sensors, and/or the like.

Using vehicle sensors 10, it is detected that a road user 4 is passing ego vehicle 2. Simultaneously, it is detected by vehicle sensors 10 that further road user 6 is maintaining an insufficient distance AB to vehicle 2.

Control unit 12 can communicate this violation to a driver of vehicle 2. Preferably, this can take place using a human-machine interface 14.

In parallel to the communication via human-machine interface 14, the relevant sensor data regarding the detected violation by road user 6 are signed by control unit 12 and stored in a vehicle-internal memory 16. Preferably, vehicle-internal memory 16 and control unit 12 are designed to be manipulation-proof.

The relevant and stored sensor data can be transmitted via a communication unit 18 in an automated manner or in response to a query by the driver of vehicle 2. A communication link 20 to an external server unit 22 can be established using communication unit 18. Communication link 20 can be, for example, a mobile radio link according to a GSM, UMTS, LTE standard, and the like.

Server unit 22 can ascertain or check the violation by road user 6 based on the transmitted sensor data and generate a report 24 for forwarding to authorities.

Figure 2:
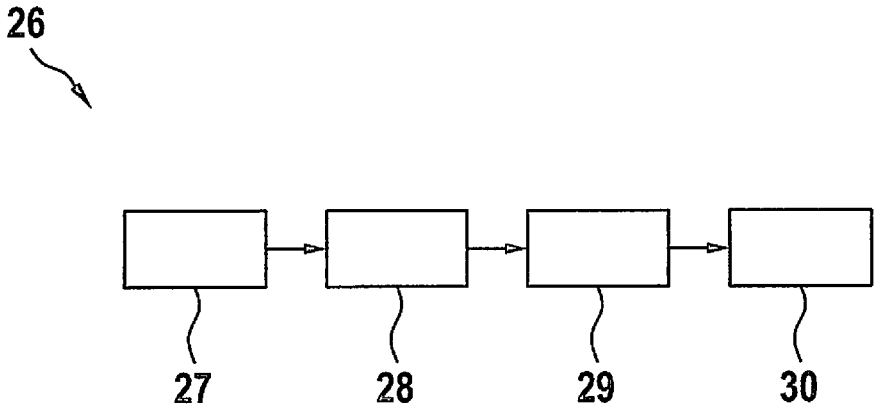
FIG. 2 is a flowchart that illustrates a method according to an example embodiment of the present invention.

FIG. 2 is a flowchart for illustrating method 26 according to the present invention for ascertaining illegal behavior of at least one road user 4, 6 in surroundings A of vehicle 2. In step 27, surroundings A are detected by vehicle sensors 10. Based on the sensor data of vehicle sensors 10, a surroundings model is created 28 by control unit 12. Thereafter, an illegal behavior of the at least one road user 6 is detected 29 on the basis of the surroundings model. The sensor data in a time window of the detected illegal behavior are stored 30 as evidence in a memory 16. Preferably, the sensor data can be stored in memory 16 in an encrypted or protected manner so that a legally certain securing of the evidence is made possible based on the stored sensor data.

What is claimed is:

1. A method for ascertaining illegal behavior of at least one road user in a surroundings of a vehicle, the method comprising:

detecting the surroundings using at least one vehicle sensor to produce sensor data;

generating a surroundings model based on the sensor data;

detecting an illegal behavior of the at least one road user based on the surroundings model and communicating the illegal behavior to a driver of the vehicle via a human-machine interface;

in parallel to the communicating via the human-machine interface, storing the sensor data in an encrypted and/or cryptographically signed manner in association with a time window in which the illegal behavior is detected; and transmitting the sensor data to a server that is external to the vehicle and that is configured to generate a report associated with the illegal behavior based on the sensor data.

2. The method of claim 1, wherein the storage of the sensor data in association with the time window is in a non-transitory memory of the vehicle.

3. The method of claim 1, wherein the storage of the sensor data in association with the time window is in a non-transitory memory of a server that is external to the vehicle.

4. The method of claim 1, wherein the detection of the illegal behavior includes ascertaining distances between: (i) a plurality of road users and (ii) the vehicle and the plurality of road users, and evaluating the distances based on speeds of the plurality of road users.

5. The method of claim 1, wherein the detection of the illegal behavior includes comparing speeds of the at least one road user in the surroundings of the vehicle to a maximum threshold speed.

6. The method of claim 1, wherein the detection of the illegal behavior includes detecting trajectories of road users in the surroundings of the vehicle and checking the trajectories against no-passing zones or illegal passing processes.

7. A control unit comprising a processor, wherein the processor is configured to perform a method for ascertaining illegal behavior of at least one road user in a surroundings of a vehicle, the method comprising:

obtaining from at least one vehicle sensor data produced by the at least one vehicle sensor based on a detection of the surroundings;

generating a surroundings model based on the sensor data;

detecting an illegal behavior of the at least one road user based on the surroundings model and communicating the illegal behavior to a driver of the vehicle via a human-machine interface;

in parallel to the communicating via the human-machine interface, storing the sensor data in an encrypted and/or cryptographically signed manner in association with a time window in which the illegal behavior is detected; and transmitting the sensor data to a server that is external to the vehicle and that is configured to generate a report associated with the illegal behavior based on the sensor data.

8. A non-transitory computer-readable medium on which are stored instructions that are executable by a processor and that, when executed by the processor, cause the processor to perform a method for ascertaining illegal behavior of at least one road user in a surroundings of a vehicle, the method comprising:

obtaining from at least one vehicle sensor data produced by the at least one vehicle sensor based on a detection of the surroundings;

generating a surroundings model based on the sensor data;

detecting an illegal behavior of the at least one road user based on the surroundings model and communicating the illegal behavior to a driver of the vehicle via a human-machine interface;

in parallel to the communicating via the human-machine interface, storing the sensor data in an encrypted and/or cryptographically signed manner in association with a time window in which the illegal behavior is detected; and transmitting the sensor data to a server that is external to the vehicle and that is configured to generate a report associated with the illegal behavior based on the sensor data.

* * * * *